US006971985B2

(12) United States Patent
Perlatti

(10) Patent No.: US 6,971,985 B2
(45) Date of Patent: Dec. 6, 2005

(54) ISOLATION CHAMBER

(75) Inventor: Deano Perlatti, Bainbridge Island, WA (US)

(73) Assignee: Seattle Tarp Company, Seattle, WA (US)

( * ) Notice: Subject to any disclaimer, the term of this patent is extended or adjusted under 35 U.S.C. 154(b) by 0 days.

(21) Appl. No.: 10/453,277

(22) Filed: Jun. 2, 2003

(65) Prior Publication Data

US 2004/0111008 A1 Jun. 10, 2004

Related U.S. Application Data

(63) Continuation-in-part of application No. 10/315,484, filed on Dec. 9, 2002.

(51) Int. Cl.[7] ..... A61G 10/00
(52) U.S. Cl. ..... 600/21
(58) Field of Search ..... 128/849, 897, 128/854, 202, 16, 12; 600/21–22; 135/116, 135/117, 128; 27/28; 383/61; 5/625–629; 312/1–6

(56) References Cited

U.S. PATENT DOCUMENTS 5,342,121 A * 8/1994 Koria ..... 312/1
6,241,653 B1 * 6/2001 Gauger et al. ..... 600/21
6,321,764 B1 * 11/2001 Gauger et al. ..... 135/128
6,418,932 B2 * 7/2002 Paschal, Jr. et al. ..... 128/845
6,461,290 B1 * 10/2002 Reichman et al. ..... 600/21

OTHER PUBLICATIONS

Casualty Care Systems, ® Gentex Corporation, www.gentexcorp.com, Carbondale, PA.

* cited by examiner

*Primary Examiner*—Samuel G. Gilbert
(74) *Attorney, Agent, or Firm*—Robert R. Richardson, P.S.

(57) ABSTRACT

An isolation chamber for providing containment for a contaminated patient includes a flexible enclosure that is configurable to receive a contaminated patient therein. The enclosure includes a first side, a second side, a top that is hingedly pivotable about a top of the first side, a bottom, a first end, and a second end. The top is maintained spaced apart from the bottom such that the top is maintained out of physical contact with a contaminated patient received in the enclosure. A plurality of attachment devices are disposed on at least one of the first and second sides or the first and second ends. The plurality of attachment devices are configured to attach to one of the first and second sides or the first and second ends to support members of a stretcher. If desired, ventilation may be provided within the isolation chamber.

8 Claims, 6 Drawing Sheets

ISOLATION CHAMBER

PRIORITY INFORMATION

This application is a CIP of patent application Ser. No. 10/315,484 filed with the U.S. Patent Office on Dec. 9, 2002.

FIELD OF THE INVENTION

The present invention relates generally to containment and, more specifically, to containment of contamination.

BACKGROUND OF THE INVENTION

Persons who have suffered injuries or trauma are typically transported on a stretcher by Emergency Medical System (EMS) personnel from a scene of an accident or trauma-related event to a hospital for treatment. Some precautions are currently taken to protect against spread of certain conditions from an injured person. For example, EMS personnel and other medical care providers take precautions, such as by wearing latex gloves, to protect themselves against inadvertent spread from the injured person of blood-borne pathogens, such as human immunodeficiency virus (HIV). As is known, blood-borne pathogens are transmitted only through direct contact with the injured person's blood. That is, the blood-borne pathogens do not become airborne.

However, a person in need of transport to a hospital for treatment (hereinafter, a "patient") may have been contaminated with an airborne agent. For example, the contaminated patient may have been exposed to a nuclear, biological, or chemical (NBC) agent, such as without limitation radioactive contamination, chicken pox virus, smallpox virus, anthrax virus, or chemical reagents such as chlorine products or other toxins. NBC agents become airborne, and therefore can spread contamination readily if they are not contained.

Transporting and treating a contaminated patient presents several issues. For example, EMS personnel initially treat the patient at the scene and enroute to the hospital. Therefore, EMS personnel and a vehicle in which the contaminated patient is transported may become contaminated. Further, the hospital where the contaminated patient is treated, as well as medical care providers who treat the contaminated patient at the hospital, may also become contaminated.

It would be desirable to prevent spread of contamination from a contaminated patient. However, there are not any containment devices for a contaminated patient of which the applicant is aware that are compact, lightweight, and easy to use. Therefore, there is an unmet need in the art for a containment device for a contaminated patient.

SUMMARY OF THE INVENTION

The present invention provides an isolation chamber that provides containment for a contaminated patient. Advantageously, embodiments of the present invention are usable with different types of stretchers, and are lightweight, easy to use, and storable in a small, compact space. Further, after the isolation chamber has been used to provide containment for a contaminated patient, the isolation chamber may be sterilized for future use or disposed of, as desired.

According to one embodiment of the present invention, an isolation chamber for providing containment for a contaminated patient may be used with a hospital-type stretcher. The isolation chamber includes a flexible enclosure that is configurable to receive a contaminated patient therein. The enclosure includes a first side, a second side, a top that is hingedly pivotable about a top of the first side, a bottom, a first end, and a second end. The top is maintained spaced apart from the bottom such that the top is maintained out of physical contact with a contaminated patient received in the enclosure. A plurality of attachment devices are disposed on at least one of the first and second sides or the first and second ends. The plurality of attachment devices are configured to attach at least one of the first and second sides or the first and second ends to support members of a stretcher.

According to an aspect of the invention, a plurality of enclosures is provided to releasably attach the top to the first and second ends and the second side. The plurality of closures help maintain the top spaced apart from the bottom.

According to another exemplary embodiment of the present invention, an isolation chamber for providing containment for a contaminated patient may be used with a field stretcher. The isolation chamber includes a flexible enclosure that is configurable to receive a contaminated patient therein. The enclosure includes a first end that defines a pocket that extends about a periphery of the first end. The enclosure also includes a second end, a bottom and a top. The top has a first section that is hingedly pivotable about a first side of the bottom and a second section that is hingedly pivotable about a second side of the bottom. A first rod conforms to a shape of the periphery of the first end, and the first rod is receivable in the first pocket. At least one enclosure is disposed on the first and second sections of the top, and the at least one closure is configured to releasably attach the first section of the top to the second section of the top. At least first webbing traverses the bottom between the first and second sides of the bottom.

According to another exemplary embodiment, handles are provided toward the first and second ends, thereby allowing the isolation chamber to be used as a field stretcher.

According to another exemplary embodiment, ventilation may be provided to a contaminated patient received in the isolation chamber.

BRIEF DESCRIPTION OF THE DRAWINGS

The preferred and alternative embodiments of the present invention are described in detail below with reference to the following drawings.

DETAILED DESCRIPTION OF THE INVENTION

By way of overview, the present invention provides an isolation chamber that provides containment for a contaminated patient. Advantageously, embodiments of the present invention are usable with different types of stretchers and are lightweight, easy to use, and storable in a small, compact space. Further, after the isolation chamber has been used to provide containment for a contaminated patient, the isolation chamber may be sterilized for future use or disposed of, as desired.

Figure 1:
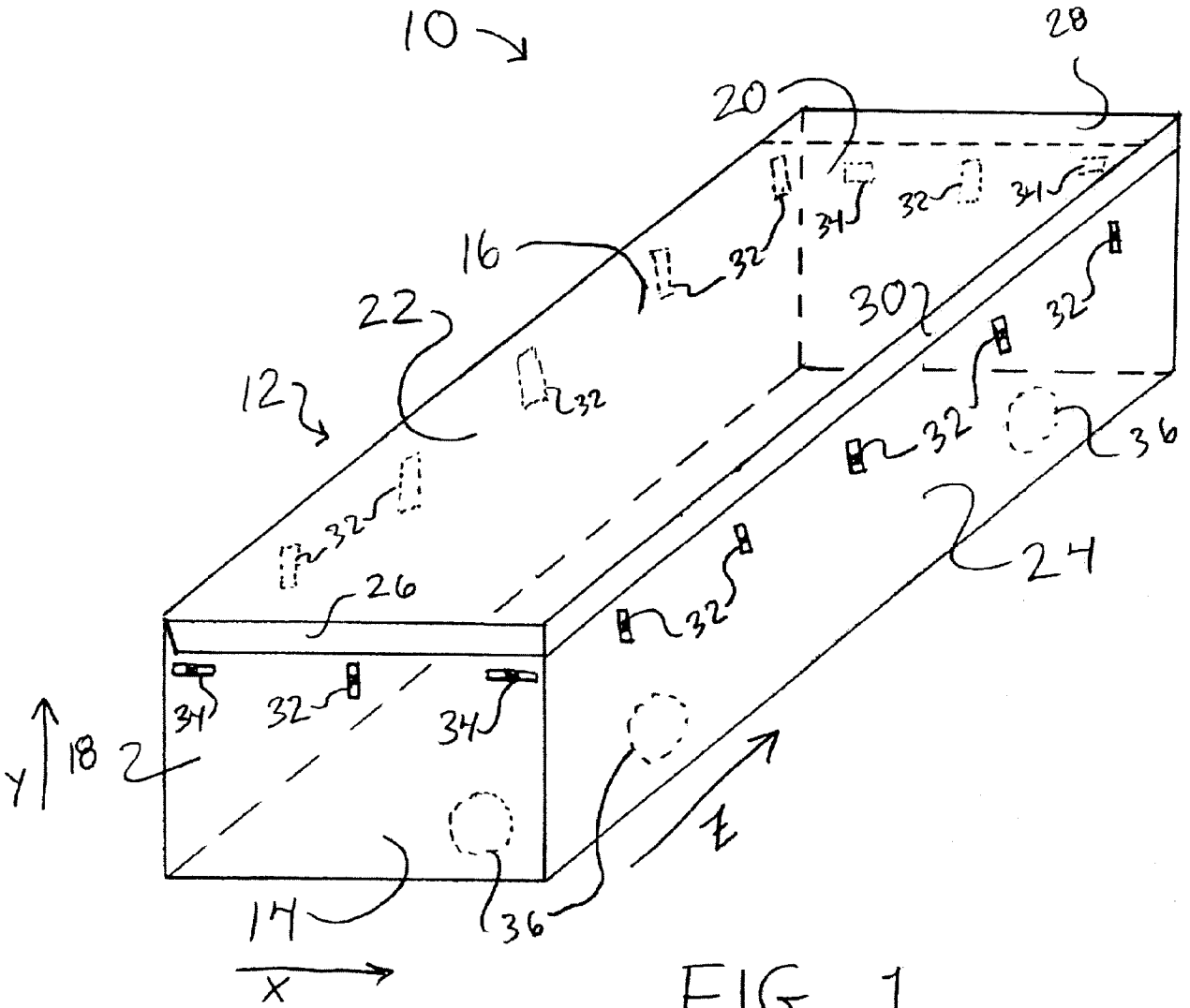
FIG. 1 is a perspective view of one embodiment of an exemplary isolation chamber of the present invention.

Referring now to FIG. 1, an exemplary isolation chamber 10 provides containment for a contaminated patient (not shown) received therein and is configured to be used with a stretcher with railings, such as a hospital-type stretcher (not shown). The isolation chamber 10 includes a flexible enclosure 12. The enclosure 12 is suitably made from a flexible material that may be rolled up or folded into a compact shape for storage, such as in a storage container or a bag, unrolled or unfolded into a desired shape for use, and that retains its shape while in use. Given by way of non-limiting example, the enclosure 12 may be made out of polyvinyl chloride (PVC). For example, without limitation the PVC may have a thickness in a range of around $^{16}/_{1000}$ inch (mil) to around 30 mil. However, it will be appreciated that any thickness of material for the enclosure 12 may be selected as desired for a particular application. Further, the enclosure 12 may be made from material that can be seen through, such as clear PVC or colored PVC. Advantageously, this permits a contaminated patient in the isolation chamber 10 to see outside the isolation chamber 10 and permits the contaminated patient to be seen by EMS personnel, other medical care providers, and other people outside the isolation chamber 10.

The enclosure 12 includes a bottom 14 (shown in phantom), a top 16, a first end 18, a second end 20 (shown in phantom), a first side 22 (shown in phantom), and a second side 24. It will be appreciated that the enclosure 12 is shown in a shape ready for use instead of configured for storage. The discussion herein is directed toward the shape ready for use. In one present embodiment, the bottom 14 and the top 16 are substantially rectangular and have substantially the same dimensions as each other. Similarly, the first and second ends 18 and 20 are substantially rectangular and have substantially the same dimensions as each other. Likewise, the first and second sides 22 and 24 are substantially rectangular and have substantially the same dimensions as each other. The bottom 14, top 16, first and second ends 18 and 20, and first and second sides 22 and 24 are sized such that the enclosure 12 suitably defines a volume that is sized to receive an average-sized person therein. For example, exemplary dimensions given by way of non-limiting example include a height of around 11 inches along a y direction, a width of around 26 inches along an x direction, and a length of around 78 inches along a z direction. It will be appreciated that any dimension in any direction may be selected as desired for a particular application.

The top 16 defines a first flap 26 adjacent and overhanging the first end 18, a second flap 28 (shown in phantom) adjacent and overhanging the second end 20, and a third flap 30 adjacent and overhanging the second side 24. The flaps 26, 28, and 30 and the first and second ends 18 and 20 and the second side 24 are advantageously provided with closures (not shown) that releasably attach the top 16 to the first and second ends 18 and 20 and to the second side 24. The flaps 26, 28, and 30 and the closures thereby cooperate to provide a means for maintaining the top 16 spaced apart from the bottom 14 and out of physical contact with a contaminated patient received in the enclosure 12. The closures may include any acceptable type of closure, such as without limitation hook-and-loop closures, zippers, snaps, and the like.

Except for the releasable attachment of the top 16 to the first and second ends 18 and 20 and to the second side 24 as discussed above, the bottom 14, the top 16, the first and second ends 18 and 20, and the first and second sides 22 and 24 are suitably attached to adjacent components of the enclosure 12 by any acceptable attachment method. Non-limiting examples of acceptable attachment methods include stitching or other bonding methods, such as welding techniques like dielectric or radio frequency (RF) welding. A plurality of loops 32 are provided on exterior surfaces of the first and second ends 18 and the first and second sides 22 and 24. The loops advantageously permit the isolation chamber 10 to be attached to rails disposed on a stretcher (not shown). The loops 32 are suitably made of any acceptable material and are attached to the first and second ends 18 and 20 and to the first and second sides 22 and 24 in any acceptable manner. In one exemplary embodiment, the loops 32 are made from hook-and-loop fastener material to permit fast, easy, and secure attachment of the isolation chamber 10 to a stretcher.

If desired, a plurality of corner loops 34 may be provided on exterior surfaces of the first and second ends 18 and 20 outboard of the loops 32 and located toward corners of the first and second ends 18 and 20. The corner loops 34 advantageously align with vertical posts (not shown) provided on some stretchers and receive the vertical posts therein. This provides additional stability when the stretcher includes vertical posts, or provides a primary means for stabilizing the isolation chamber 10 on a stretcher without rails (thereby rendering the loops 32 unused).

If desired, a plurality of ports 36 are suitably provided within the enclosure 12. The ports 36 advantageously provide EMS personnel and other medical care providers an ability to access the contaminated patient and to connect desired devices to the contaminated patient without detaching the top 16. For example, the ports 36 may permit oxygen tubes, intravenous tubes, and wires for monitoring devices such as an electrocardiogram or devices for monitoring other vital signs to be connected to the contaminated patient. The ports 36 are suitably defined by any acceptable method, such as a weld path. To create an opening at a desired location, the selected port 36 is removed, such as by poking or cutting. Alternately, the connections to the contaminated patient may be provided by running the desired connection between the top 16 and the first or second end 18 or 20 or the second side 24, as desired. In such a case, the closure is closed around the connection to maintain the top 16 closed.

Figure 2:
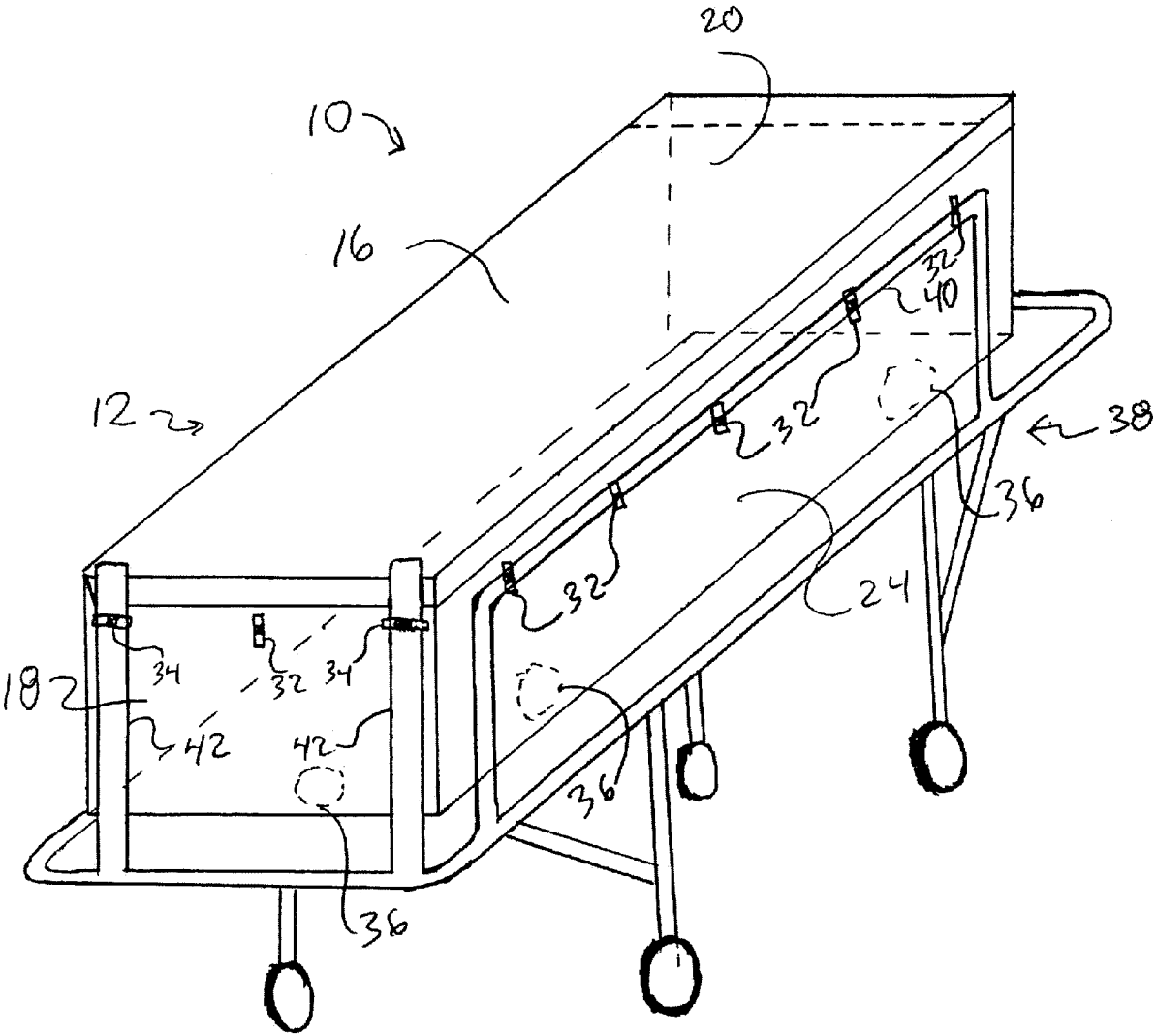
FIG. 2 is a perspective view of the isolation chamber of FIG. 1 in use on an exemplary stretcher.

Referring now to FIGS. 1 and 2, operation of the isolation chamber 10 will be explained. The isolation chamber 10 is removed from storage and is laid out on a stretcher 38, such as without limitation a hospital-type stretcher. The loops 32 are closed around the rails 40 of the stretcher 38. Alternately, or in addition, the corner loops 34 are closed around posts 42 of the stretcher, if desired. The closures are opened, thereby permitting the top 16 to be opened. With the top 16 opened, the enclosure 12 is shaped for use. The contaminated patient is placed in the isolation chamber 10. The closures are closed to attach the top 16 to the first and second ends 18 and 20 and to the second side 24. The closure is closed around any connections, such as an intravenous connection or an oxygen tube or wires for monitoring devices, to the contaminated patient. The ports 36 are opened as desired. After treatment, the contaminated patient is removed from the isolation chamber 10 and the isolation chamber 10 may be disposed of or sanitized using known methods for further use, as desired.

Figure 3:
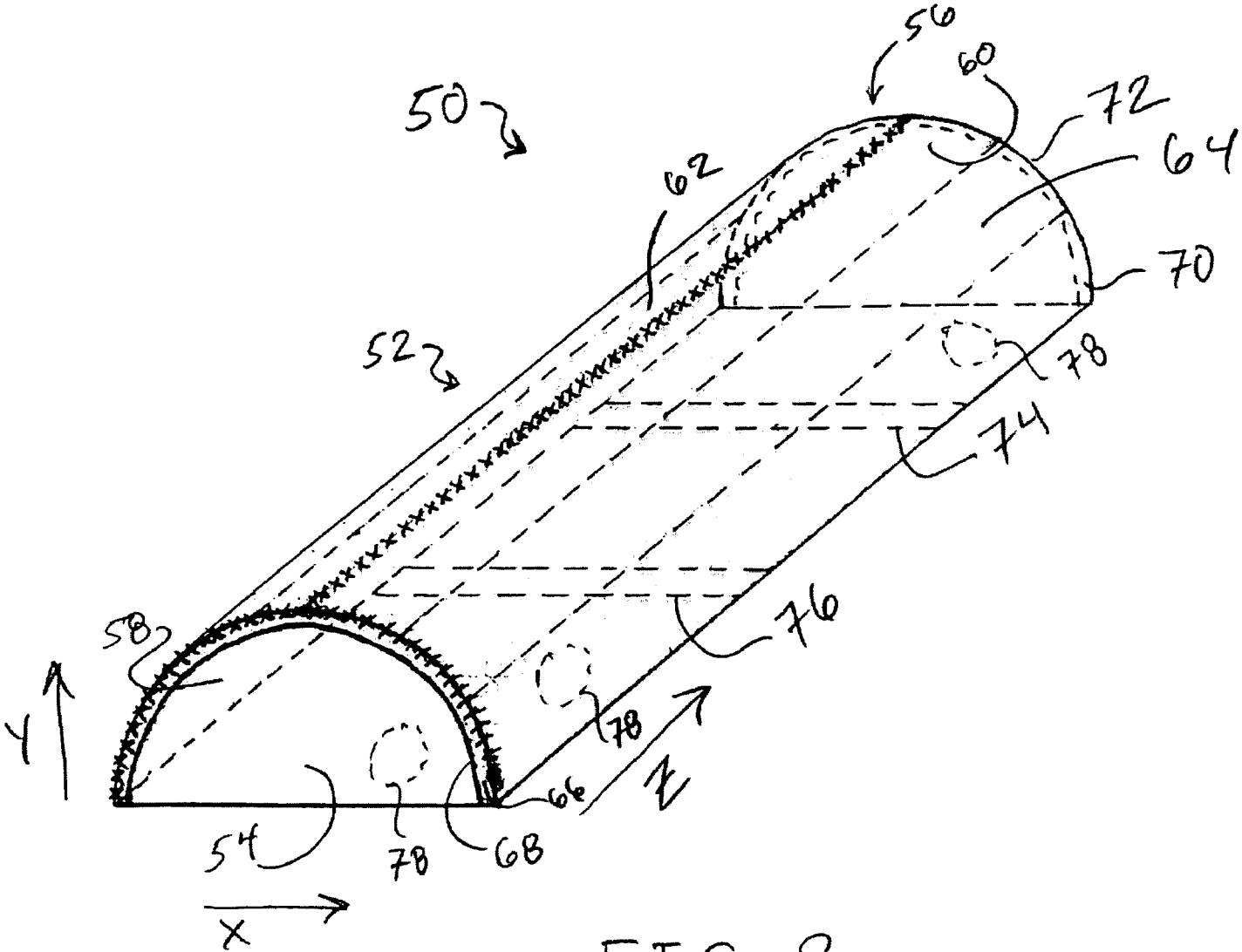
FIG. 3 is a perspective view of an alternate embodiment of an exemplary isolation chamber of the present invention.

Referring now to FIG. 3, an alternate embodiment of an isolation chamber 50 provides containment for a contaminated patient (not shown) received therein and is configured to be used with a rail-less stretcher, such as a field-type stretcher (not shown). The isolation chamber 50 shares many components in common with the isolation chamber 10 (FIG. 1). As a result, repetition of details of common components is not necessary for an understanding of the isolation chamber 50. The isolation chamber 50 includes a flexible enclosure 52. The enclosure 12 is suitably made from the same material as the enclosure 12 (FIG. 1).

The enclosure 52 includes a bottom 54 (shown in phantom), a top 56, a first end 58, and a second end 60 (shown in phantom). The top includes a first section 62 and a second section 64. In one present embodiment, the bottom 14 is substantially rectangular. The first and second sections 62 and 64 are also are substantially rectangular and have substantially the same dimensions as each other. The first end section 62 is hingedly pivotable about a first side of the bottom 54, and the second section 64 is hingedly pivotable about a second side of the bottom 54. The first and second ends 58 and 60 are substantially semi-circular and have substantially the same dimensions as each other. The bottom 54, top 56, and first and second ends 58 and 60 are sized such that the enclosure 52 suitably defines a volume along x, y, and z directions similar to that of the enclosure 10 (FIG. 1).

The first end 58 defines a first pocket 66 about a periphery of the first end 58. A first support member, such as a first rod 68, conforms to a shape of the periphery of the first end 58. The rod 68 may be made of any material as desired, such as nylon, aluminum, steel, or the like. Given by way of non-limiting example, the periphery of the first end 58, the first pocket 66, and the first rod 68 are substantially semi-circular. The first rod 68 is inserted in the first pocket 66 to enable the first end 58 to retain its desired shape for use. If desired, the second end 60 may define a second pocket 70 about a periphery of the second end 60. In this case, a second support member, such as a second rod 72 that is similar to the first rod 68, conforms to a shape of the periphery of the second end 60. The second rod 72 is inserted in the second pocket 70 to enable the second end 60 to retain its desired shape for use.

Closures are provided along edges where the first and second sections 62 and 64 intersect to releasably attach the first and second sections 62 and 64 to each other. Closures may also be provided, if desired, along the peripheries of the fist and second ends 58 and 60 and the first and second sections 62 and 64 where the first and second sections 62 and 64 intersect the first and second ends 58 and 60. This permits the first and second sections 62 and 64 to be releasably attached to the first and second ends 58 and 60. The pockets 66 and 70, rods 68 and 72, and closures thereby provide a means for maintaining the top 56 spaced apart from the bottom 54 and out of physical contact with a contaminated patient received in the enclosure 52. The closures may include any acceptable type of closure, such as without limitation hook-and-loop closures, zippers, snaps, and the like. Except for the releasable attachment of the first and second sections 62 and 64 to each other and to the first and second ends 58 and 60 as discussed above, the bottom 54, the top 56, and the first and second ends 58 and 60 are suitably attached to adjacent components of the enclosure 52 as discussed above for the enclosure 12 (FIG. 1).

Advantageously, at least first webbing, such as polypropylene webbing 74 (shown in phantom), transverses the bottom 54 between first and second sides of the bottom 54. The webbing 74 is suitably provided interior or exterior the enclosure 52. However, the webbing 74 is preferably provided exterior the enclosure 52 in order to minimize materials potentially contaminated by a contaminated patient received in the isolation chamber 50. The webbing 74 advantageously provides support for weight of the contaminated patient received in the isolation chamber 50. Accordingly, the webbing 74 is suitably located along the bottom 54 to provide support in an approximate location of buttocks of the contaminated patient. However, it will be appreciated that the webbing 74 may be located as desired. Additionally, if desired, second webbing 76 that is similar to the first webbing 74 may provide additional support for weight of the contaminated patient. The second webbing 76 may be located as desired, such as without limitation in an approximate location of the back of the contaminated patient.

Finally, a plurality of ports 78, similar to the plurality of ports 36 (FIG. 1), may be provided as desired.

The isolation chamber 50 operates as follows. The enclosure 52 is removed from storage and is laid out on a suitable surface. The closures are opened, thereby permitting the top 56 to be opened. With the top 56 opened, the enclosure 52 is shaped for use. The first rod 68 is inserted in the first pocket 66. If desired, the second rod 72 is inserted in the second pocket 70. The contaminated patient is placed in the isolation chamber 50, and the isolation chamber 50 is lifted onto a rail-less stretcher, such as a field stretcher (not shown). The closures are closed to attach the first and second sections 62 and 64 to each other and to the first and second ends 58 and 60. The closures are closed around any connectors, such as an intravenous connector or an oxygen tube or wires for monitoring devices, to the contaminated patient. The ports 78 are opened as desired. After treatment, the contaminated patient is removed from the isolation chamber 50 and the isolation chamber 50 may be disposed of or sanitized using known methods for further use, as desired.

Figure 4:
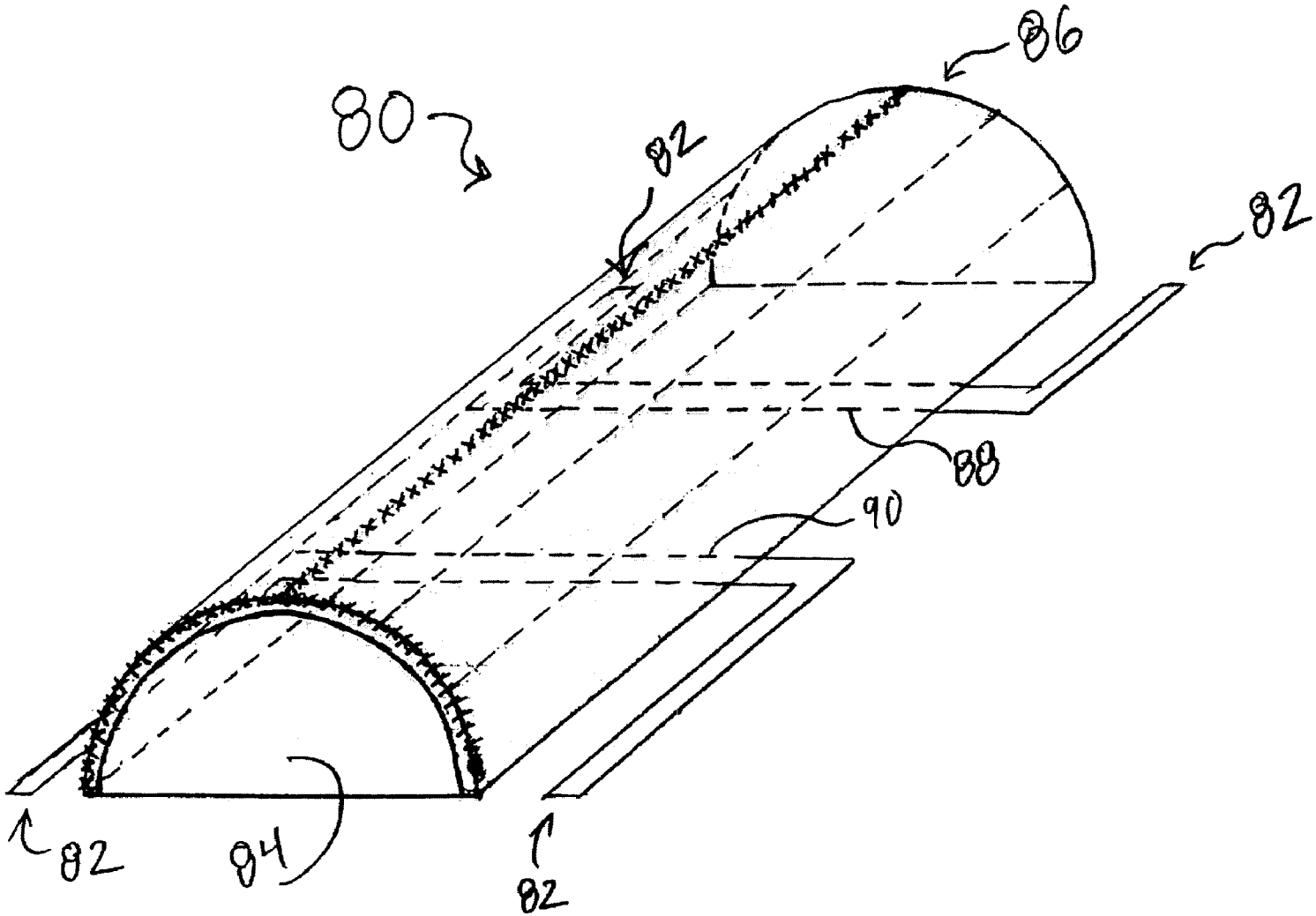
FIG. 4 is a perspective view of a variant of the isolation chamber of FIG. 3.

Referring now to FIG. 4, an isolation chamber 80 is a variant of the isolation chamber 50 (FIG. 3) that advantageously also functions as a field stretcher. In addition to features of the isolation chamber 50 (FIG. 3) already described herein, the isolation chamber 80 includes handles 82 that are provided toward first and second ends 84 and 86. If desired, the handles may extend from first and second webbing 88 and 90. Alternately, the handles 82 may be provided as hand-holds disposed at the first and second ends 84 and 86 or as any acceptable hand-hold known in the art. The isolation chamber 80 operates similar to the isolation chamber 50 (FIG. 3), except it is not necessary to lift the isolation chamber 80 onto a rail-less stretcher, such as a field stretcher. This is because the isolation chamber 80 may be lifted and carried by the handles 82, thereby functioning as its own field stretcher.

Figure 5:
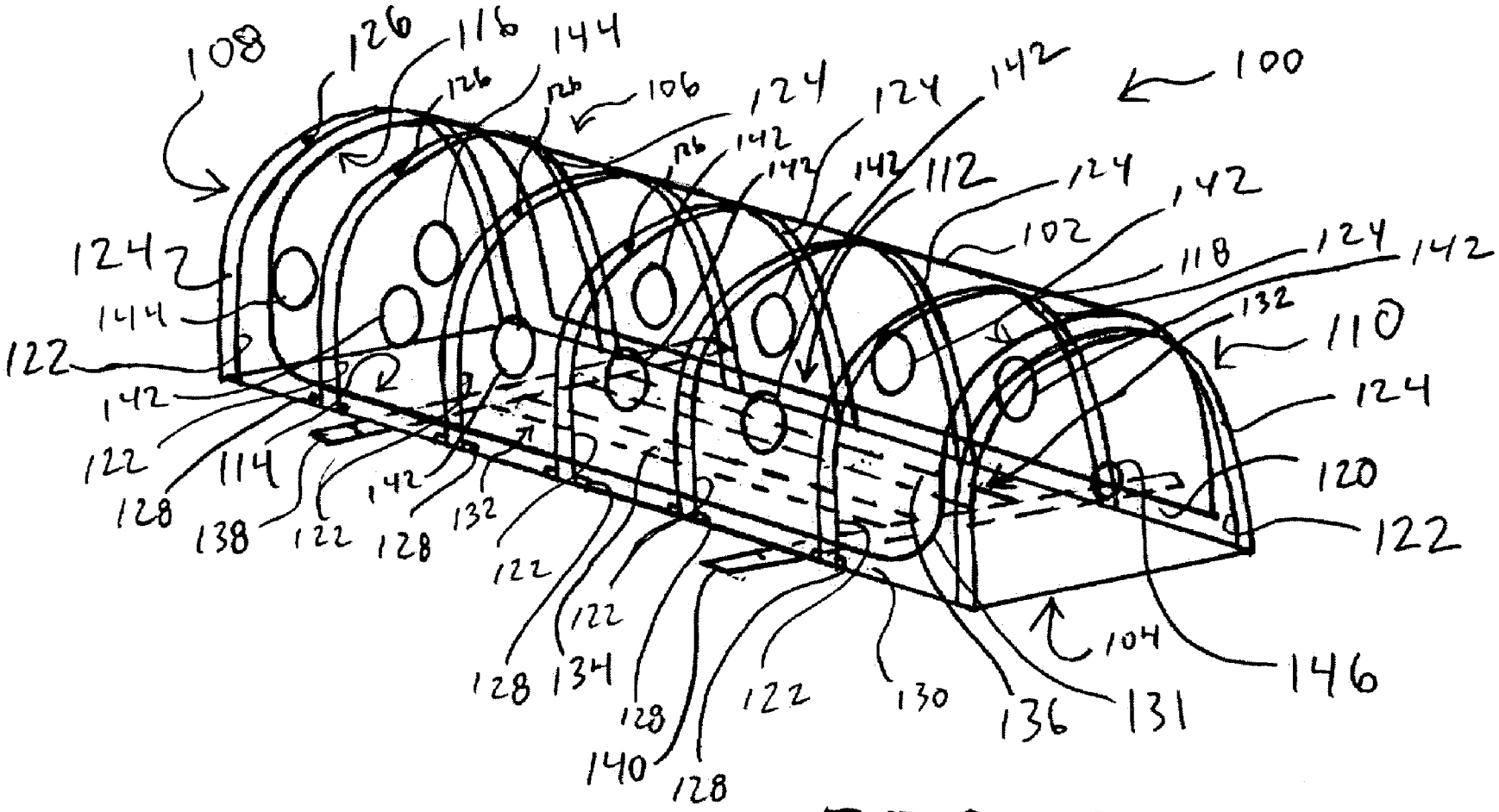
FIG. 5 is a perspective view of an exemplary isolation chamber according to another embodiment of the present invention.

Referring now to FIG. 5, another alternate embodiment of an isolation chamber 100 provides containment for a contaminated patient (not shown) received therein and is configured to be used with a stretcher with railings, such as a hospital-type stretcher (not shown). The isolation chamber 100 advantageously provides increased support for maintaining a lid off a patient received therein. The isolation chamber 100 also provides for increased airflow within the isolation chamber 100 and for increased access to a patient received therein.

The isolation chamber 100 shares many components in common with the isolation chambers 10 (FIG. 1), 50 (FIG. 3), and 80 (FIG. 4). As a result, repetition of details of common components is not necessary for an understanding of the isolation chamber 100. The isolation chamber 100 includes a flexible enclosure 102. The enclosure 102 is suitably made from the same material as the enclosure 12 (FIG. 1).

The enclosure 102 includes a base or bottom 104, a lid 106, a first end 108, and a second end 110. In one present embodiment, the bottom 104 is substantially rectangular. The first and second ends 108 and 110 are substantially semi-circular and have substantially the same dimensions as each other. The lid 106 includes a first side section 112, a second side section 114, a first end section 116, and a second end section 118. The first side section 112 is hingedly attached to the bottom 104 along a top edge 120 of the bottom 104. By way of nonlimiting example, the lid 106 may be sewed or stitched to the top edge 120 of the bottom 104 along the first side section 112, and any acceptable strengthening material, such as fabric, may be used as desired to strengthen the stitching. Alternately, the lid 106 may be RF welded to top edge 120 of the bottom 104 along the first side section 112. The first and second end sections 116 and 118 are substantially semi-circular and have substantially the same dimensions as each other. The bottom 104, lid 106, and first and second ends 108 and 110 are sized such that the enclosure 102 suitably defines a volume along x, y, and z directions similar to that of the enclosure 10 (FIG. 1).

The first end 108 defines a pocket 122 about a periphery of the first end 108. The pocket 122 suitably is made by attaching a piece of material, such as the same material as the enclosure 102, to the first end 108. In one embodiment, the pocket 122 is defined along an interior of the enclosure 102 and is attached by RF welding. It will be appreciated that the pocket 122 may be made of any flexible material as desired, and may be attached to the interior or the exterior of the enclosure 102 in any acceptable manner, such as without limitation by sewing.

A support member, such as a rib 124, conforms to a shape of the periphery of the first end 108 and is inserted in the pocket 122. The rib 124 may be made of any suitable material as desired, such as without limitation, nylon, aluminum, steel, plastic, polypropylene, or the like. Given by way of non-limiting example, the periphery of the first end 108, the pocket 122, and the rib 124 are substantially semi-circular. The rib 124 is inserted in the pocket 122 to enable the first end 108 to retain its desired shape for use. If desired, the rib 124 may be affixed to the enclosure 102 with a fastener 126, such as without limitation a screw.

The second end 110 defines another pocket 122 about a periphery of the second end 110 in which another rib 124 is inserted and, if desired, affixed. Construction and details of the second end 110, the pocket 122 at the second end 110, and the rib inserted into the pocket 122 at the second end 110 are the same as the first end 108 and the pocket 122 and the rib 124 at the first end 108. For sake of brevity, repetition of details of their construction are not necessary for an understanding of the present invention.

According to the present invention, a plurality of the pockets 122 are defined across a width of the lid 106. The plurality of the pockets 122 are substantially parallel to each other and are longitudinally spaced apart from each other. The plurality of the pockets 122 are defined along either the interior or exterior of the lid 106, as desired, in the same manner as the pockets 122 are defined at the first and second ends 108 and 110. A plurality of the ribs 124 are inserted into the plurality of the pockets 122 defined in the lid 106 and, if desired, affixed in the same manner as described above for the ribs 124 at the first and second ends 108 and 110. Advantageously, the plurality of the ribs 124 along the lid 106 help maintain the lid 106 along its length from being gravitationally urged onto a patient received within the isolation chamber 100. That is, the plurality of the ribs 124 thereby provide a means for maintaining the lid 106 spaced apart from the bottom 104 and out of physical contact with a contaminated patient received in the enclosure 102.

The plurality of the ribs 124 may advantageously extend beyond the second side section 114 of the lid 106. In this case, the plurality of the ribs 124 have a length that extends to the bottom 104. A plurality of receptacles 128 are defined along either an interior or exterior of a side section 130 of the enclosure 102 that is adjacent the second side section 114 of the lid 106. The plurality of the receptacles 128 are defined along the interior of the side section 130 when the plurality of the pockets 122 are defined along the interior of the lid 106. Likewise, the plurality of the receptacles 128 are defined along the exterior of the side section 130 when the plurality of the pockets 122 are defined along the exterior of the lid 106. The receptacles 128 are suitably made from the same material as the enclosure 102 and are attached to the side section 130 in any acceptable manner, such as without limitation RF welding. The receptacles 128 are shaped to receive therein ends of the ribs 124 that extend beyond the second side section 114 of the lid 106. As such, in one embodiment the receptacles 128 are rectangularly shaped. However, it will be appreciated that the receptacles 128 may have any shape as desired. As discussed below, in order to increase ease of closing and opening the lid 106, in one present embodiment the plurality of the pockets 122 are preferably defined along an interior of the lid 106 and the plurality of the receptacles 128 are preferably defined along an interior of the side section 130. However, in an alternate embodiment, the plurality of the pockets 122 and the plurality of the receptacles 128 are suitably defined along the exterior of the lid 106 and the side section 130, respectively.

A closure 131 is provided along edges where the lid 106 releasably attaches to the first and second ends 108 and 110 and to the side section 130. In one embodiment, the closure 131 includes a zipper. However, it will be appreciated that any acceptable closure may be used as desired, such as without limitation hook-and-loop closures, snaps, and the like.

A pair of pockets 132 are longitudinally defined along an exterior of the bottom 104. The pockets 132 suitably are defined in the same manner as are the pockets 122. The pockets 132 longitudinally traverse the exterior of the bottom 104 a length about as long as the lid 106. Webbing 134 and 136, shown in phantom, are longitudinally received in the pair of pockets 132. The webbing 134 and 136 suitably include polypropylene webbing. The webbing 134 and 136 advantageously provide support for weight of the contaminated patient received in the isolation chamber 100. Accordingly, the webbing 134 and 136 is suitably long enough to provide support for a contaminated patient in an approximate location from below buttocks of the contaminated patient to around the upper back of the contaminated patient. However, it will be appreciated that the webbing 134 and 136 may be located as desired.

Additionally, webbing 138 (shown in phantom) is attached to ends of the webbing 134 and 136 toward the first end 108 of the enclosure 102. The webbing 138 is suitably made of the same material as the webbing 134 and 136. The webbing 138 is arranged substantially perpendicular to the webbing 134 and 136. The webbing 138 extends beyond both sides of the enclosure 102 and provides two handles or hand holds for carrying the isolation chamber 100 and any contaminated patient that may be received therein. If desired, ends of the webbing 138 may be stitched or otherwise formed into loops to provide hand holds for personnel to grab while transporting a patient received in the isolation chamber 100. Furthermore, webbing 140 (shown in phantom) that is similar to the webbing 138 is attached to ends of the webbing 134 and 136 toward the second end 110 of the enclosure 102. The webbing 140 is constructed, arranged, and attached in the same manner as the webbing 138 to provide additional handles or hand holds for carrying the isolation chamber 100 and any contaminated patient that may be received therein.

A plurality of ports 142, that may be similar to the plurality of ports 36 (FIG. 1), may be provided within the lid 106, as desired. In one embodiment, a port 142 may be located between adjacent ribs 124. If desired, a port 142 may be located on each side of the lid 106. The ports 142 suitably may be attached to the lid 106 via a gasket, or may be RF welded, or attached in any known manner, as desired. The ports 142 may be sized as desired for a particular application. Given by way of nonlimiting example, the ports 142 may have a diameter of between around 4 inches to around 6 inches to permit personnel to put hands through the ports 142 to access a contaminated patient received in the isolation chamber 142. If desired, the ports 142 may have a construction to enhance ease of access inside the enclosure 102. For example, given by way of nonlimiting example, the ports 142 may have threaded throats (not shown) on which lids (not shown) are threadedly engaged. It will be appreciated, however, that the ports 142 may have any size and construction as desired.

According to the present invention, additional ports may be included to provide for ventilation inside the isolation chamber 100. At least one port 144 is provided in the first end 108. If desired, more than one port 144 may be provided in the first end 108. The port(s) 144 are suitably constructed in the same manner as the ports 142. As discussed below, the port(s) 142 are opened to permit air to enter the isolation chamber 100 for ventilation. Alternately, the port(s) 144 permit personnel access to a contaminated patient received in the isolation chamber 100.

Figure 6:
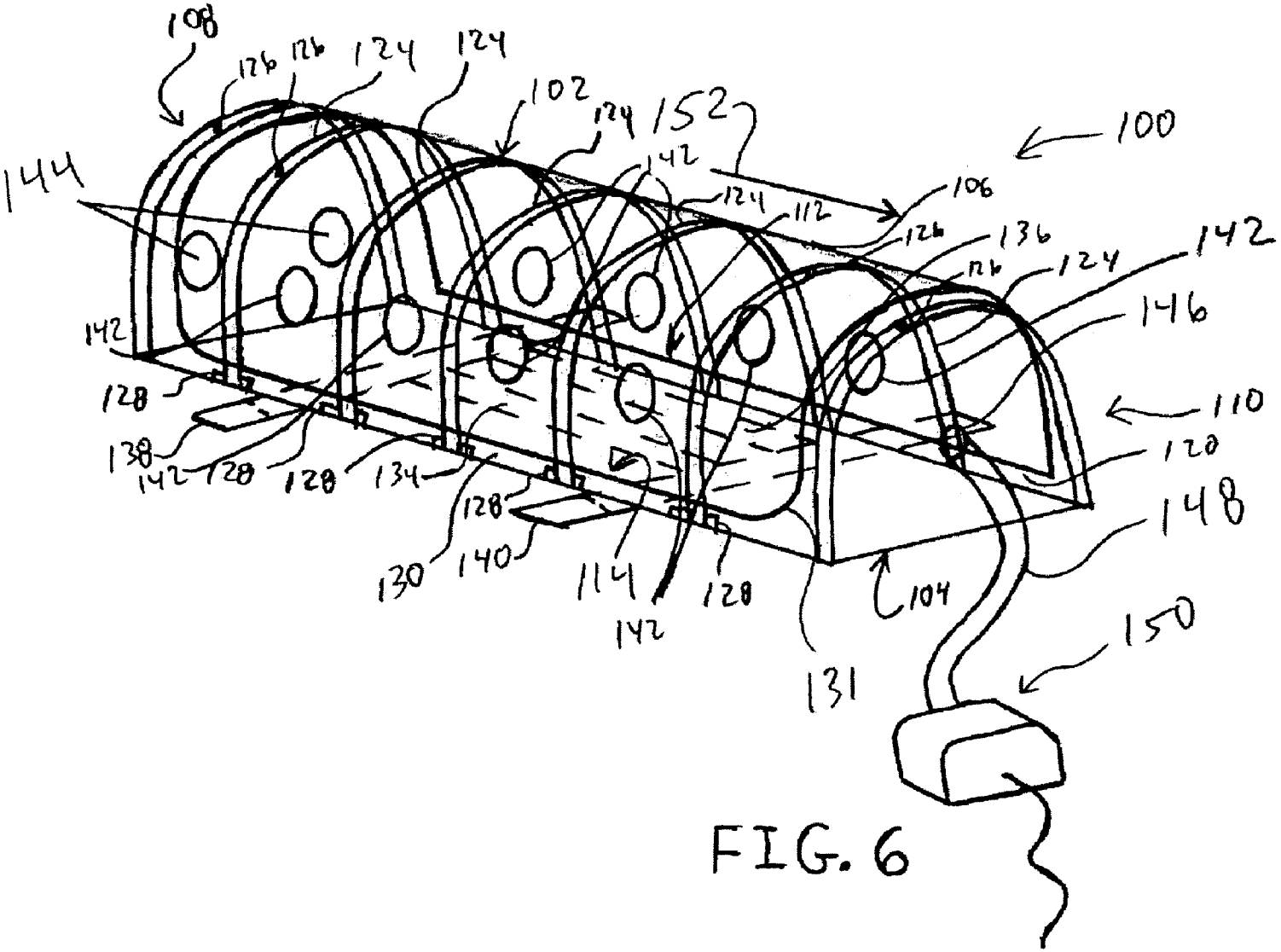
FIG. 6 is a perspective view of the isolation chamber of FIG. 5 configured to provide ventilation.

Referring now to FIGS. 5 and 6, a port 146 is provided in the second end 110. The port 146 advantageously is configured to be connected to a hose 148 for a vacuum, such as without limitation a high efficiency particulate (HEPA) vacuum. When the ports 144 are open and the vacuum 150 is connected to the port 146, the vacuum 150 advantageously draws an air flow through the isolation chamber 100 in a direction indicated by an arrow 152, thereby providing ventilation inside the isolation chamber 100.

The isolation chamber 100 operates as follows. The isolation chamber advantageously is collapsible to a compact shape for storage in a suitable container, such as a PVC bag or the like. The enclosure 102 is removed from storage and is laid out on a suitable surface. One of the ports 142 is preferably opened to permit air to enter the enclosure 102, and the enclosure 102 is expanded to its full length. It will be appreciated that opening one of the ports 142 permits air to enter the enclosure 102, thereby decreasing likelihood of drawing a vacuum that may bind the enclosure 102 during expansion. The closure 131 is opened, thereby permitting the lid 106 to be opened. With the lid 106 opened, the isolation chamber 100 is ready to receive a contaminated patient therein is shaped for use.

The contaminated patient is placed in the isolation chamber 100. Preferably, the contaminated patient's head is placed toward the first end 108 and the contaminated patient's feet are placed toward the second end 110. As will be discussed below, this permits air to enter the isolation chamber 100 near the patient's head and flow toward the patient's feet. The lid 106 is closed, and the ends of the plurality of the ribs 124 are engaged within the plurality of the receptacles 128. The closure 131 is closed to attach the lid 106 to the first and second ends 108 and 110 and to the side section 130. Any connectors, such as an intravenous connector or an oxygen tube or wires for monitoring devices, are routed to the contaminated patient via any of the ports 142 or 144, as desired. The isolation chamber 100 is lifted via the handles or hand holds provided at the ends of the webbing 138 and 140 onto a stretcher (not shown).

At a desired point during or after transport to a treatment facility, such as a hospital, the hose 148 is connected to the port 146. The vacuum 150 is energized and pulls air into the isolation chamber 100 through the ports 144, past the patient's head and through the isolation chamber 100 in the direction of the arrow 152, and out of the isolation chamber 100 through the port 146. After treatment, the contaminated patient is removed from the isolation chamber 100, and the isolation chamber 100 may be disposed of or sanitized using known methods for further use, as desired.

While the preferred embodiment of the invention has been illustrated and described, as noted above, many changes can be made without departing from the spirit and scope of the invention. Accordingly, the scope of the invention is not limited by the disclosure of the-preferred embodiment. Instead, the invention should be determined entirely by reference to the claims that follow.

What is claimed is:

1. An isolation chamber for providing containment of a contaminated patient, the isolation chamber comprising:

a flexible enclosure configurable to receive and transport a contaminated patient therein, the enclosure including:

a first end;

a second end;

a bottom member that is attached to the first and second ends, the bottom member having an edge between the first and second ends of the enclosure; and a lid having a first side and a second side and third and fourth ends, the lid being hingedly pivotable along the first side about the bottom member;

a plurality of handles attached to the enclosure toward the first and second ends of the enclosure;

a plurality of spaced-apart ribs configured to maintain the lid vertically spaced apart from a patient received in the flexible enclosure, an end of each of the ribs extending past the second side of the lid;

a plurality of spaced-apart pockets defined along an interior of the lid, the plurality of ribs being received in the plurality of pockets;

a plurality of spaced-apart receptacles defined on an interior of the bottom member adjacent the edge of the bottom member, the end of each of the plurality of ribs being receivable and retainable in the plurality of receptacles; and a closure configured to releasably close the second side of the lid along the edge of bottom member and to releasably close the third and fourth ends of the lid along the first and second ends of the enclosure, respectively.

2. The isolation chamber of claim 1, wherein the plurality of pockets are defined across the lid from the first side of the lid toward the second side of the lid.

3. The isolation chamber of claim 1, further comprising first webbing that longitudinally traverses the bottom member, the first webbing being directly attached to an underside of the bottom member such that the bottom member is configured to support weight of the contaminated patient received in the enclosure without further reinforcement.

4. The isolation chamber of claim 1, further comprising a plurality of first ports defined within the lid such that a rib is interposed between adjacent first ports.

5. The isolation chamber of claim 4, further comprising:

at least one second port defined in the first end; and a third port defined in the second end.

6. The isolation chamber of claim 5, wherein the third port is configured to be attached to a vacuum.

7. The isolation chamber of claim 1, wherein the handles include:

second webbing attached to an end of the first webbing toward the first end of the enclosure; and third webbing attached to an end of the first webbing toward the second end of the enclosure.

8. The isolation chamber of claim 1, wherein the closure includes a zipper.

* * * * *